US011897585B1

(12) United States Patent
Falzone et al.

(10) Patent No.: US 11,897,585 B1
(45) Date of Patent: Feb. 13, 2024

(54) ANCHORING FLOATING STRUCTURES TO AN UNDERWATER FLOOR

(71) Applicant: RCAM Technologies, Inc., Boulder, CO (US)

(72) Inventors: Gabriel David Falzone, Los Angeles, CA (US); Mason James Bell, Long Beach, CA (US); Jason Rust Cotrell, Boulder, CO (US)

(73) Assignee: RCAM Technologies, Inc., Boulder, CO (US)

( * ) Notice: Subject to any disclaimer, the term of this patent is extended or adjusted under 35 U.S.C. 154(b) by 0 days.

(21) Appl. No.: 18/455,350

(22) Filed: Aug. 24, 2023

Related U.S. Application Data

(60) Provisional application No. 63/400,656, filed on Aug. 24, 2022.

(51) Int. Cl.
*B63B 21/30* (2006.01)

(52) U.S. Cl.
CPC ..... *B63B 21/30* (2013.01)

(58) Field of Classification Search
CPC ..... B63B 21/24; B63B 21/26; B63B 21/29; B63B 21/30; B63B 2021/265; B63B 21/50; E02D 27/525
USPC ..... 114/294, 295, 300
See application file for complete search history.

(56) References Cited

U.S. PATENT DOCUMENTS 3,402,689 A 9/1968 James et al.
3,411,473 A 11/1968 Mott et al.
3,496,900 A 2/1970 Mott et al.
4,165,707 A * 8/1979 Valent ..... B63B 21/29 114/294
8,215,873 B1 7/2012 Lugo et al.
8,698,338 B2 4/2014 Slocum et al.
9,435,096 B2 * 9/2016 Shin ..... E02D 27/50
(Continued)

FOREIGN PATENT DOCUMENTS

JP 2015034430 2/2015
KR 20130094410 8/2013
(Continued)

OTHER PUBLICATIONS

KIPO, International Search Report and Written Opinion dated Oct. 27, 2020, in PCT/US2020/017973, 10 pgs.
(Continued)

*Primary Examiner* — Daniel V Venne
(74) *Attorney, Agent, or Firm* — Henry Patent Law Firm PLLC

(57) ABSTRACT

In a general aspect, an anchor includes a tubular body that is formed at least in part of cementitious material and has open and closed ends. The anchor also includes a pad eye coupled to the tubular body and configured to couple to a mooring line. The tubular body includes a base wall, a perimeter wall, and a shear key. The base wall defines the closed end of the tubular body and has first and second surfaces on opposite sides of the base wall. The perimeter wall extends from the first surface of the base wall to the open end of the tubular body, and the shear key extends from the second surface of the base wall. The shear key is configured to penetrate an underwater floor and resist a lateral displacement of the anchor along the underwater floor when penetrated therein.

19 Claims, 13 Drawing Sheets

(56) References Cited

U.S. PATENT DOCUMENTS

| | | | | |
|---|---|---|---|---|
| 10,309,071 | B2 * | 6/2019 | Krstulović-Opara | E02B 17/0021 |
| 11,448,193 | B2 * | 9/2022 | Wong | B63B 35/44 |
| 2006/0127187 | A1 | 6/2006 | Raines | |
| 2010/0318222 | A1 | 12/2010 | Khoshnevis | |
| 2011/0094432 | A1 | 4/2011 | Petersen | |
| 2022/0002961 | A1 | 1/2022 | Cotrell | |
| 2022/0063769 | A1 | 3/2022 | Cotrell et al. | |
| 2022/0178340 | A1 | 6/2022 | Cotrell | |

FOREIGN PATENT DOCUMENTS

| | | |
|---|---|---|
| WO | 2017148961 | 9/2017 |
| WO | 2020176262 | 9/2020 |

OTHER PUBLICATIONS

EPO, Communication pursuant to Article 94(3) issued in Application No. 20763934.5 dated Jun. 30, 2023, 6 pages.
EPO, Extended European Search Report dated Mar. 10, 2022, in EP 20763934.5, 8.
ISA, International Search Report and Written Opinion issued in Application No. PCT/US2023/031063 dated Nov. 14, 2023, 11 pages.

* cited by examiner

ANCHORING FLOATING STRUCTURES TO AN UNDERWATER FLOOR

CROSS-REFERENCE TO RELATED APPLICATIONS

This application claims priority to U.S. Prov. App. No. 63/400,656, which was filed on Aug. 24, 2022 and entitled "Anchoring Floating Structures to an Underwater Floor." The disclosure of the priority application is hereby incorporated by reference in its entirety.

BACKGROUND

The following description relates to anchoring floating structures to an underwater floor.

An anchor may be used to fix or restrict the location of a body floating on water. To do so, the anchor may be deployed on an underwater floor and connected to the floating body via cable, rope, or chain. The anchor may rely on its mass to remain stationary on the underwater floor, thereby creating a tension force through the connection that restrains the motion of the floating body. In certain cases, multiple anchors can be used to apply multiple restraining forces to the floating body. The presence of multiple anchors may serve to mitigate the risk of one or more connections failing. The presence of multiple anchors may also limit the drift of the floating body around a desired location.

DETAILED DESCRIPTION

In a general aspect, anchors are described for securing floating structures to an underwater floor. The floating structures may, for example, be renewable energy structures such as floating solar energy systems, wave energy systems, and wind energy systems in freshwater or saltwater bodies of water (e.g., inland or offshore). In some implementations, the anchors are configured to secure floating solar energy systems, which can have mooring loads one or two orders of magnitude lower than floating wave energy and wind systems (e.g., 15 tons vs. 1500 tons holding capacity).

Figure 1:
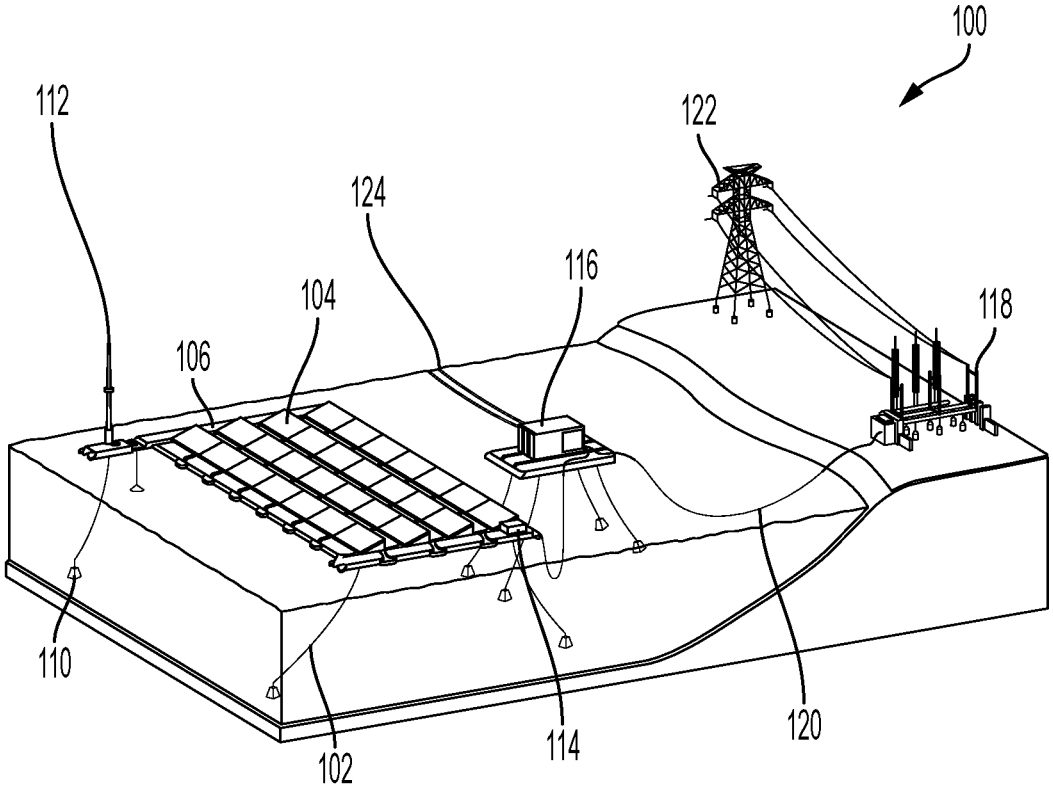
FIG. 1 is a schematic diagram, in perspective view, of an example floating photovoltaic system anchored to an underwater floor by mooring lines.

Mooring and anchoring is a critical challenge in systems and applications, for example, in the development of reliable and low-cost floating photovoltaics (FPV) and other types of systems. FPV systems are capable of affixing photovoltaic (PV) panels to floating pontoons that are kept in place by mooring lines connected to anchors. FIG. 1 presents a schematic diagram, in perspective view, of an example FPV system 100 that is anchored to an underwater floor by mooring lines 102. Deploying photovoltaic panels on bodies of water can create opportunities for solar energy where ground-mount or rooftop systems are limited or infeasible. The example FPV system 100, as shown in FIG. 1, includes a plurality of PV modules 104 disposed on floats or pontoons 106 that are secured by mooring lines 102. The mooring lines 102 are connected to anchors 110. FIG. 1 also shows a lightning protection system 112 (grounding for metal PV module mounting hardware). a combiner box 114, a central inverter 116 (floating or shore based). a transformer 118, underwater cables 120, a transmission tower 122, and connections 124 to other floating solar PV arrays.

FPV systems can be anchored using concrete blocks (e.g., deadweight/gravity bodies), helical anchors, and driven piles. These anchors, however, may have restrictions for their deployment. For example, helical anchors commonly require divers to install them underwater and they only work in a small subset of soils. Steel piles often require expensive heavy-duty equipment to install. Concrete gravity anchors work in a broad set of soil conditions and are quick to install, but their crude shape makes them heavy and material intensive.

As an example, an FPV system may use 10-30 conventional block anchors per megawatt, each weighing 2-5 tons and costing $350-$500 per ton (USD). A typical 10 MWp plant may thus use 700 tons of concrete costing about $300,000 (USD). This large amount of concrete can be difficult to handle, and custom barges may need to be fabricated at each site for the purpose of installing the block anchors. Moreover, each block is significantly overdesigned due to its limited horizontal load capacity, which is approximately one-third that in the vertical direction. Such overdesign is also needed to mitigate risks of improper mooring, as failures in anchoring can lead to catastrophic system failure, injury, and possibly death.

The anchors described herein can provide advantages over conventional anchors. For instance, the anchors described herein can reduce costs, improve efficiency, simplify manufacturing and configuration, and improve mechanical stability and functionality. Other advantages are possible.

In some implementations, the anchors described herein include a "squat" (e.g., wide aspect ratio) body that relies on the mass of the anchor structure during installation to secure a floating structure to an underwater floor. In some variations, the anchors also include suction chamber that provides a suction force during installation. The suction force may assist the mass of the anchor in securing the anchor to the underwater floor. In these variations, the anchors may correspond to a hybrid anchor. In some implementations, the anchors lack fluid ports (e.g., for generating the suction forces in a suction chamber), which allows the body of the anchors to have a simpler configuration. However, the anchors can still benefit from the generation of suction forces during brief periods of high dynamic loads, such as during rough weather. The anchors may be formed of cementitious materials (e.g., concrete, reinforcing elements, aggregate, etc.). In some variations, the anchors include features that reduce the amount of cementitious materials and reinforcements needed for their construction. Such reduction can lower the cost of the anchor as well as lowering an amount greenhouse gases that are emitted during the making of the cementitious materials.

Additional features or benefits of the anchors can include one or more of the following: [1] Low-cost (and low-carbon intensity) ballast materials in the body of the anchor (e.g., locally sourced aggregate, recycled concrete or other waste); [2] Wavy or undulating walls to increase a stiffness and a strength of walls that define the body of the anchor; [3] Co-location reinforcement materials for the pad eye, body floor (e.g., base wall), and shear keys to reduce the amount of reinforcement; [4] The incorporation of fillets and cavities in a floor of the anchor to reduce stress concentrations and reduce an amount concrete and reinforcement materials; [5] Closed shear key shapes that create suction forces; [6] Shear key shapes arranged to support the ballast gravity loads on the body floor (e.g., the base wall); and [7] Shear key shapes with profiles that increase the torsional resistance of the anchor. Other features and benefits are possible.

Figure 2A:
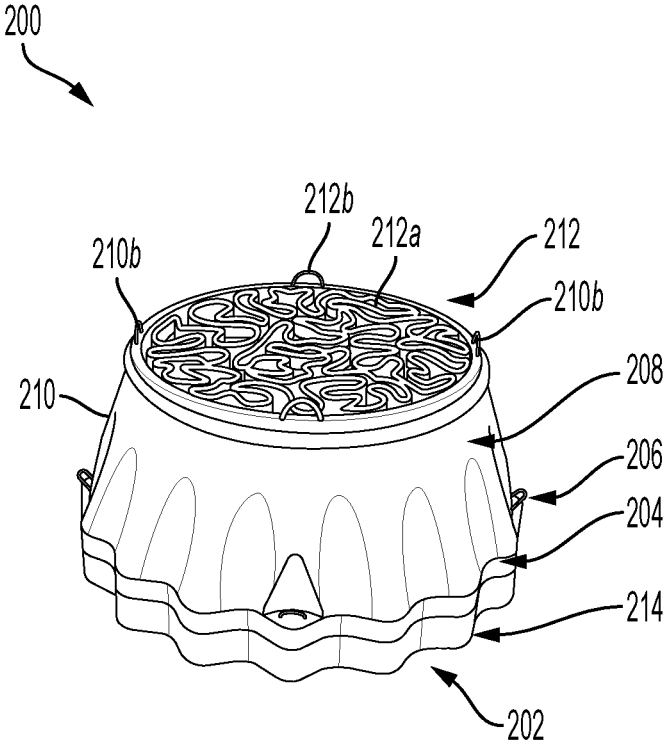
FIG. 2A is a schematic diagram, in top perspective view, of an example anchor for securing floating structures to an underwater floor.

In FIG. 2A, a schematic diagram is presented, in top perspective view, of an example anchor 200 for securing a floating structure to an underwater floor, such as a FPV system. The example anchor 200 may include one or more of the features and benefits described above. As shown in FIG. 2A, the example anchor 200 includes a shear key 202, a base wall 204, one or more pad eye connections 206, body walls 208 (e.g., a perimeter wall 210), and a lid 212. The shear key 200 shown in FIG. 2A includes teeth 214 and body walls 208 that form a hollow body with a wavy profile for holding ballast. As shown in FIG. 2A, the lid 212 includes a simulated coral surface 212*a* and lifting eyes 212*b*. In many variations, the components of the anchors are manufactured using an additive manufacturing process, such as a 3D concrete printing process. However, other manufacturing methods are possible, including combinations of methods. Examples of other possible manufacturing methods include 3D casting (which can 3D print stayform walls into which concrete materials are cast), concrete spraying, pre-casting, casting, and slip forming. The example anchor can use gravity forces—and in some configurations, also suction forces—to resist vertical and overturning forces. The example anchor can also use friction and bearing forces to resist the horizontal forces applied by mooring lines to one or more pad eyes of the example anchor. In some implementations, the example anchor is connected to one mooring line. In some implementations, the example anchor is connected to multiple mooring lines, such as in a shared-anchor configuration to reduce the number of anchors needed.

During installation, one or more shear keys of the example anchor embed partially or fully below the underwater floor to increase a bearing load capacity of the example anchor. A shear key can take a variety of shapes including open and closed profiles. FIG. 2A illustrates an example of a shear key 202 in which the shear key 202 has a closed profile. The shear key 202 can increase the vertical load capacity and overturning load capacity of the example anchor 200. The shear key 202 can also increase the horizontal load capacity of the anchor 200. These increases may be caused by a pressure differential in the example anchor 200 (e.g., between an interior and an exterior of the example anchor 200) that forms when the anchor 200 is lifted or rotated about a horizontal axis.

Figure 3:
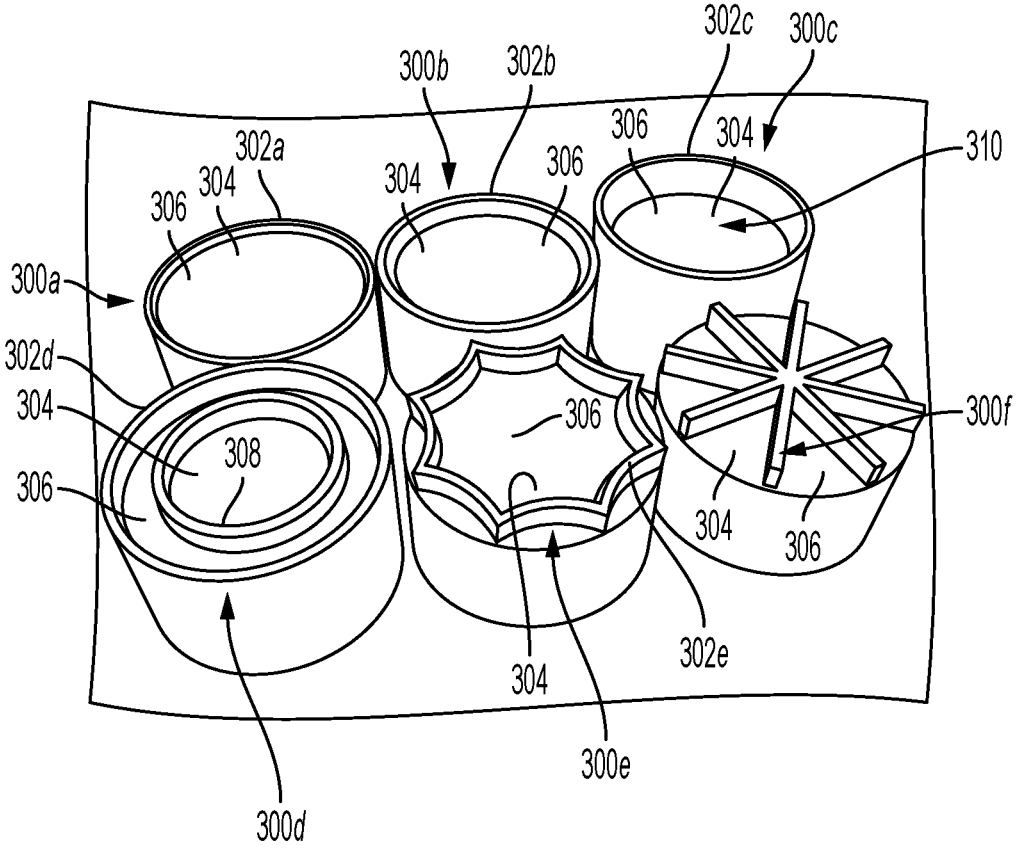
FIG. 3 is a schematic diagram that shows alternate configurations for a shear key.

FIG. 3 presents a schematic diagram that shows alternate configurations 300*a*-300*f* for a shear key 300. (The shapes are subscale for illustrative purposes.) In the schematic diagram, six example anchors are shown, each oriented "upside down" so that its shear key 300 faces up. The shear key 300 of the example anchors may include one or more walls that extend outward from a surface 304 of a base wall 306. For example, the shear key 300 may include a perimeter wall 302 that extends outward from the surface 304 of the base wall 306. The perimeter wall 302 may have various shapes, such as the circular shapes of perimeter walls 302*a*-302*d* or the star shape of perimeter wall 302*e*. In some variations, the shear key 300 includes a second wall nested within the perimeter wall 302, such as the concentric circular wall 308 of shear key 300*d*. In some variations, the base wall 306 defines a closed end for a tubular body of the example anchor (e.g., see shear key 300J). In these variations, the perimeter wall 302 may be configured to convert the closed end into an open end (e.g., see shear keys 300*a*-300*e*). For example, the perimeter wall 302 may extend sufficiently outward from the surface 302 to define an opening into a cavity of the tubular body. The cavity may, in certain cases, be configured to be a suction chamber of the example anchor. For example, the perimeter wall 302*c* of shear key 300*c* may define a cavity sufficiently deep to function as a suction chamber 310. The suction chamber 310 may be fluidly coupled to an exterior of the example anchor via a conduit. An example of such a configuration is described in relation to FIGS. 7A-7D.

Multiple walls can be used to increase the bearing resistance of the shear key 202. The example anchor 200 can also include stiffing walls that reside in an interior cavity to provide additional stiffness and strength to the base wall 204 of the example anchor 200, thereby allowing the use of a thinner, more efficient floor structure that reduces the materials used during construction. For example, the materials used to construct the floor structure may be reduced by approximately 50% compared to a solid floor slab. In some variations, the shear key 202 can include a profile that has teeth 214 to increase the torsional resistance of the example anchor 200. The teeth 214 may also stiffen the shear key 202 to allow less materials and reinforcements to be used during construction. In some variations, the shear key 202 can include a perimeter wall 210 that extends from the base wall 204 and defines an open end of the example anchor 200. The perimeter wall 210 can be referred to as a "skirt" and can contribute to limiting the scour of the underwater floor from beneath the example anchor 200. In certain cases, such as shown in FIG. 2A, the perimeter wall 210 defines part of an exterior perimeter surface of the example anchor 200.

In some implementations, the shear key 202 can provide additional mass to resist the mooring loads. The body of the example anchor 200 can have a base wall 204, as shown in bottom perspective view of FIG. 2B, to which pad eyes or hoisting connections can be connected in addition to the shear key 202. For clarity, the interior shear keys have been omitted from FIG. 2B to allow for better visibility of the reinforcement materials (e.g., rebar). The body can be hollow or solid. In some variations, the body includes a perimeter wall 210 that defines a tubular structure. The body can also include a hollow chamber to facilitate the addition of low cost, locally sourced ballast materials such as sand, rock, or recycled concrete materials. The base wall 204 may contain a reinforcement cage 216 that transfers the mooring loads from the pad eye 206 to the body and the shear key 202. The base wall reinforcement 216 can, in certain configurations, extend into the shear key 202 and its walls to provide reinforcement to these portions of the example anchor 200. Other reinforcement materials that can be used include random fibers, cables, tendons, or staples. The reinforcement materials may be part of the cementitious material. FIG. 2C shows an implementation of the example anchor 200 of FIG. 2A in which the example anchor 200 includes a shear key 202 that forms an anchor skirt. The shear key 202 includes four linear walls 218 that cross the anchor floor and define a suction chamber 220(e.g., nine suction sub-chambers) of the example anchor 200.

Figure 5:
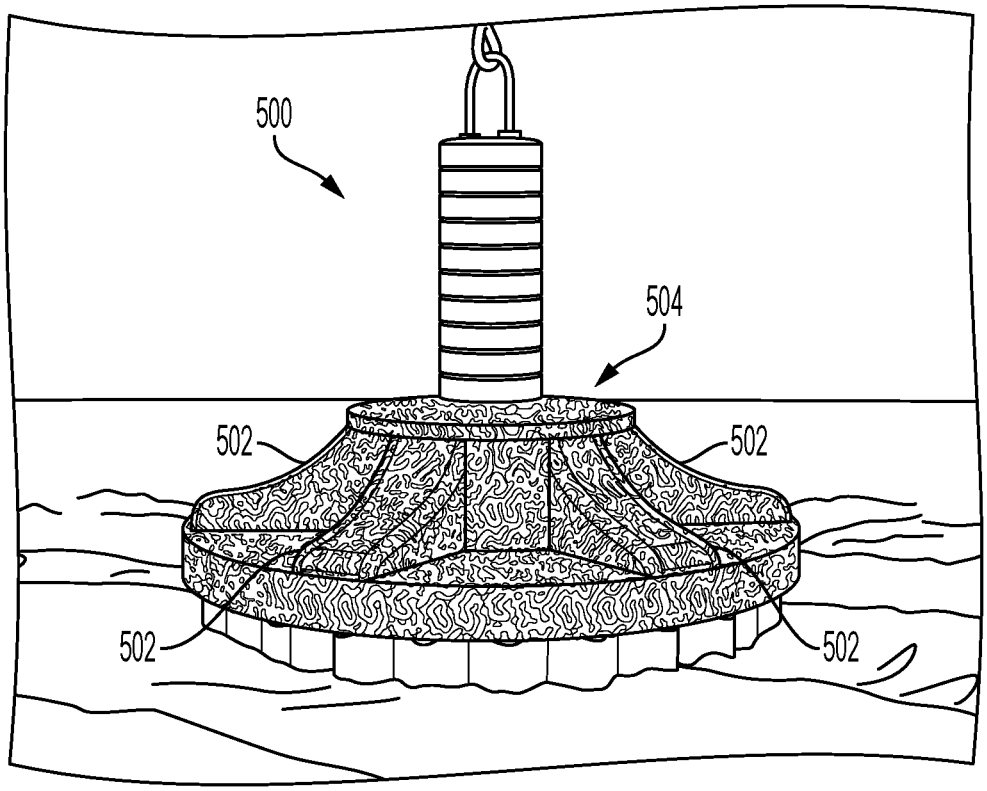
FIG. 5 is a schematic diagram, in elevation view, of an example anchor having a body printed with ribs and a textured surface.

The profile of the body can take a variety of shapes, such as cylindrical, triangular, rectangular, or some other type of shape (e.g., a frustrum). For example, the body can be cylindrical in shape with a wavy or sinusoidal perimeter wall that increases the stiffness of the body compared to a smooth wall. The wavy or sinusoidal wall may also increase the strength of the perimeter wall 210 thereby reducing the amount of materials needed to manufacture the wall 210. As another example, the body may be triangular in shape and configured to allow mooring lines to be connected at the midpoint of a base of the triangle. This shape and configuration may provide better overturning resistance by locating a connection point of a pad eye 206 closer to a center of gravity of the body. In some instances, ribs can be printed into the body to form stiffening walls that increase its stiffness and strength. FIG. 5 presents a schematic diagram, in elevation view, of an example anchor 500 having a body printed with ribs 502 and a textured surface 504.

In some implementations, the example anchor 200 can include a lid 212 that forms an enclosure for the body and restrains loose ballast materials (e.g., sand) from escaping the body. In some implementations, the lid 212 can be used with the body to create a buoyancy chamber to aid in the installation of the example anchor 200, especially in the case of very large, high capacity anchors. The buoyancy chamber, when unfilled, may allow the example anchor 200 to float when disposed on water. However, in some configurations, the body is nearly entirely filled with materials to maximize the mass of the example anchor 200.

The lid 212 may, in many variations, include a textured surface 212*a* that mimics a shape found in nature, such as coral or cavities that provide protective habitats for marine life. The textured surface 212*a* may be defined, for example, by an undulating wall on the lid 212. In doing so, the lid 212 may facilitate the growth of marine life to support a marine ecosystem and grow additional organic mass on the anchor 200. However, other lid shapes are possible, such as lids with a smooth surface or lids that partially enclose the body. For example, the lid 212 can take the form of a net filled with large ballast materials such as large rocks. Alternatively, the thickness of the lid 212 can be increased to place additional mass on top of the anchor 200. As another example, the lid 212 can take the shape of a bucket that can be filled with additional ballast to further increase the mass of the example anchor 200. This additional mass may increase a downward force on the shear key 202, which in turn, can aid during installation of the example anchor 200 in underwater beds with hard soils. In some variations, the lid 212 can include hoisting rings 212*b* to aid in during the installation and removal of the lid 212. Moreover, the lid 212 can be designed to sit on the top of the body or on a lip just below the surface of the body to facilitate the location and placement of the lid 212 on the anchor 200. The lid 212 can also be fastened to the body using fasteners or other reinforcement materials. The lid 212 may also be configured to accept adhesives (e.g., grout, epoxy, etc.) for fastening.

In some implementations, the example anchor 200 has features that can include: [1] a body that combines the use of ballast materials with a shear key. The shear key may have a closed profile that generates suction forces, thereby increasing the vertical and overturning load resistance of the example anchor; [2] The body may also have a wide-aspect ratio shape (e.g., approximately 1:1 in height to length) that maximizes the amount of ballast materials in the body relative to the amount of cementitious structural material. The body's large footprint may also provide a larger overturning resistance; [3] One or more pad eye connections that are integrated in the floor of the body, such as a base wall or a portion of a perimeter wall near the base wall. Other locations of the body are possible. This integration may allow for the incorporation of reinforcement materials in the floor or body to aid in resisting mooring loads on the pad eye as well as resisting the loads of ballast materials on the base wall; [4] Reinforcement in the floor of the body that can extend into the shear key, base wall, and perimeter wall; [5] The shape and location of the shear key walls can be designed to maximize the stiffness of the example anchor and reduce the amount of concrete materials needed to manufacture the base wall; [6] Allow for an anchor transport and installation method that is easily scalable to larger anchor sizes. For example, for very large and heavy anchors, the body—which may be hollow—can be floated out to the installation site without ballast and the lowered to the underwater floor using a smaller crane (e.g., before ballast is added to the example anchor). Any combination of these features is possible for the example anchor 200.

The example anchor 200 may also include features that facilitate its manufacturing. For example, the perimeter wall 210, the base wall 204, and the shear key 202 can be built using 3D printing, 3D casting, or 3D spray processes that aid in the inclusion of reinforcement materials. In particular, the 3D casting process may allow the use of recycled concrete materials in the concrete mix or the use of large low cost and small carbon footprint aggregates (e.g., up to ¾" in diameter or larger) that may otherwise be difficult to print or spray through a small hose or nozzle. As another example, the use of blockout materials and stayforms to create the shear key 202 and filleted surfaces of the body can reduce the amount of cementitious material used to form the base wall 204. Moreover, manufacture of the anchor shell at an offsite printing facility allows shipment of a lighter weight anchor assembly that can be filled with locally sourced ballast materials at the installation site. The anchor shell may be part of the body of the example anchor 200.

A variety of methods can be used to manufacture the example anchor 200. Additive manufacturing, for example, may allow the example anchor 200 to be manufactured in layers that can be cured, optionally repositioned, turned over, or receive castable materials. Additive manufacturing may also allow the example anchor 200 to be manufactured without first having to create supporting formwork. Moreover, 3D printed materials can then be added to the body of the example anchor 200 after it hardens for a period of time.

Figure 2B:
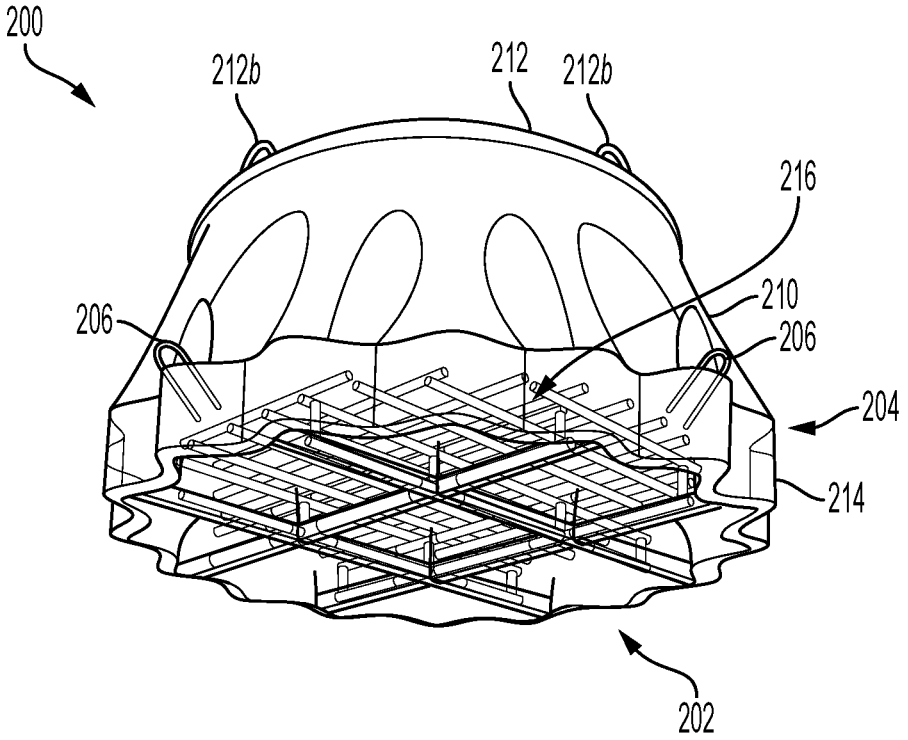
FIG. 2B is a schematic diagram, in bottom perspective view and showing a portion, in semi-transparency, of the example anchor of FIG. 2A.
Figure 2C:
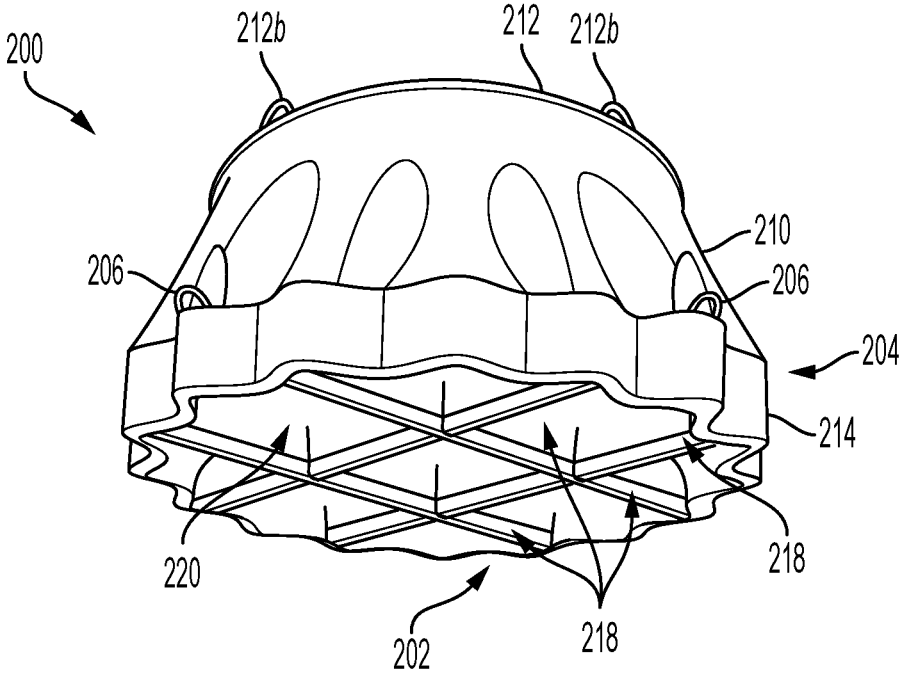
FIG. 2C is a schematic diagram, in bottom perspective view, of the example anchor of FIG. 2A, but in which the example anchor includes a shear key that has a perimeter wall and four linear walls.
Figure 4:
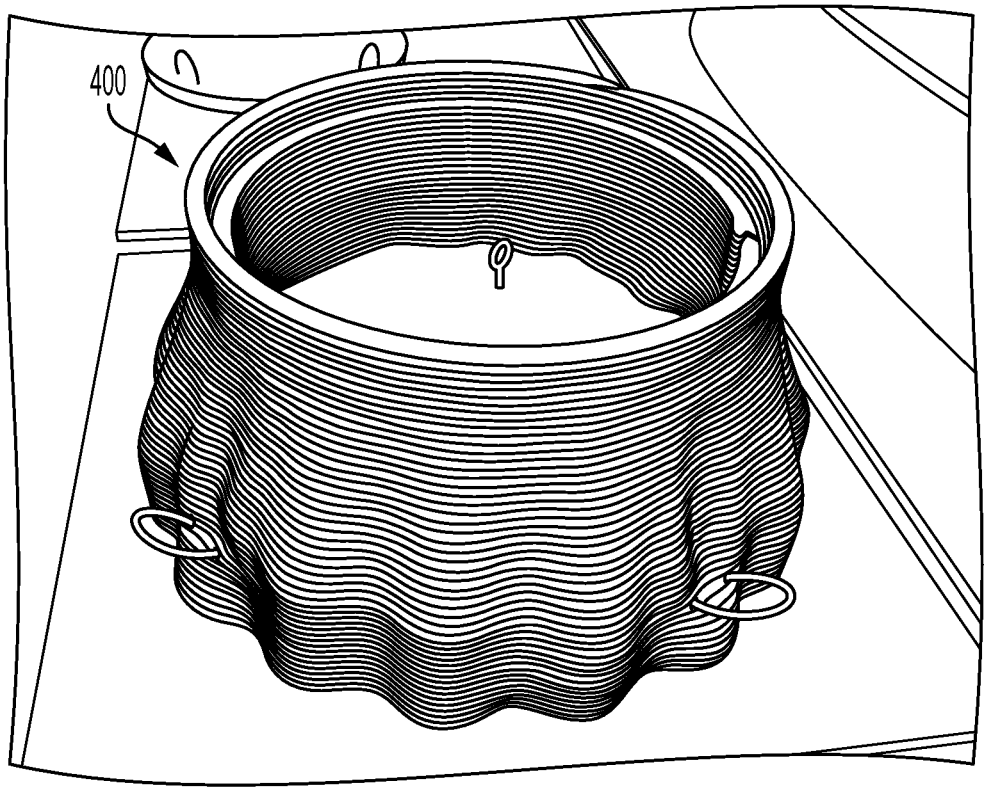
FIG. 4 is a schematic diagram, in perspective view, of an example anchor manufactured using, at least in part, a 3D concrete printing process.

In some implementations, a method of manufacturing an anchor—such as the example anchor 200 described in relation to FIGS. 2A-2C—includes 3D printing an outline of the shear key (or walls thereof) and the base wall. The outline may be referred to as a stayform. The method includes inserting blockout materials (e.g., sand or foam), reinforcement materials (e.g., non-corrosive rebar), and pad eye connections (e.g., concrete or metal hoops) into or around the stayforms. The blockout materials may create voids in the concrete structure to reduce material usage where concrete materials are not needed. The method additionally includes casting concrete materials into or around the stayforms and allowing the sub assembly (or as-fabricated body) to cure. In many implementations, the method includes printing the walls of a body of the anchor (e.g., a perimeter wall, a stiffening wall, etc.) on the base wall. FIG. 4 presents a schematic diagram, in perspective view, of an example anchor 400 manufactured using, at least in part, a 3D concrete printing process.

The anchors described herein may also provide advantages related to their design and manufacture. These advantages may be related to a digital design manufacturing process, which can include a parametric design software combined with additive manufacturing methods. The digital design process allows configurations of the anchor to be quickly and cost effectively manufactured and installed without the creation of new formwork. These configurations include various anchor sizes and shapes of the body, shear key, and surface textures, and may also include configurations that are installed in a solar plant or FPV system. Moreover, modeling software can quickly change the design of an anchor for different input assumptions and the resulting design can be quickly printed. The digital design and additive manufacturing process can provide opportunities to optimize the design of each anchor to a required holding capacity, thereby increasing the overall material efficiency of the anchors at the plant level. This increase may reduce the over-design of an anchor due to the typical use of a limited number of different molds.

The 3D printing process associated with the designed anchors can, in many cases, be very fast and cost effective due to the elimination of formwork and reduction of labor in manufacturing. In certain cases, an anchor for an FPV system can take approximately 20 minutes to print, with printers operated by 1-2 people.

The lightweight anchor shell can be manufactured using automated methods at various locations, such as offsite in an existing concrete manufacturing facility. The manufactured shell can then be shipped cost effectively to the installation site before being filled with ballast. The offsite construction process may result in a higher quality anchor due to a sheltered and more consistent manufacturing environment. Anchors can also be manufactured on-site (e.g., in situ) if larger numbers of anchors, larger sizes, or shorter shipping distances are needed.

Figure 6:
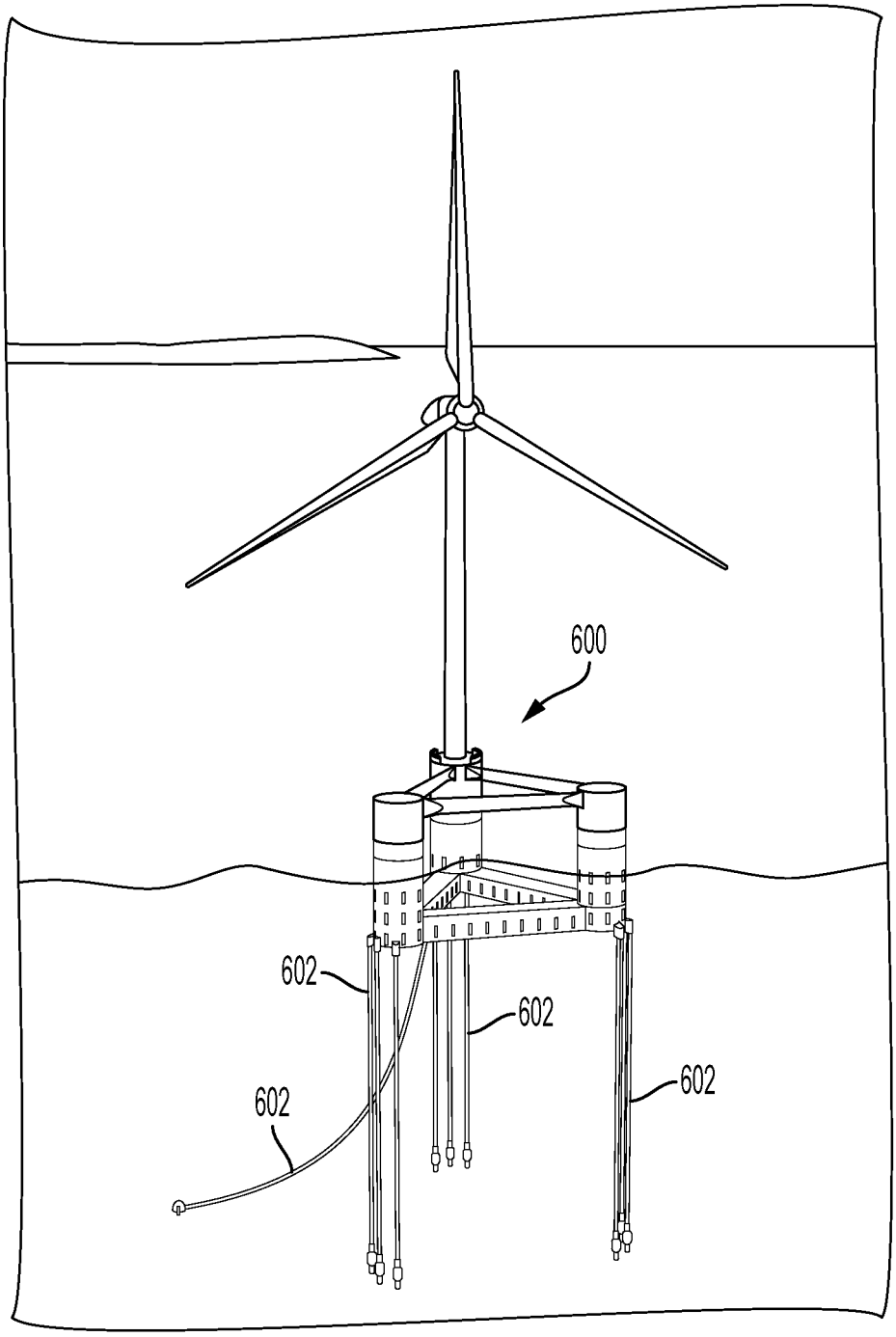
FIG. 6 is a schematic diagram, shown in elevation view, of an example a tension leg platform that supports a wind turbine and is secured to an underwater floor using nine anchors.

Furthermore, as floating wind technologies advance, the configurations of the anchors can be scaled up and deployed for mooring floating offshore wind turbines. In some settings, a primary advantage for suction anchors is that their mass resists the vertical loads. For example, the mass of the suction anchor may resist the mean vertical loads generated by a floating wind turbine substructure, such as a tension leg platform (TLP). The suction anchor may, in some cases, thus sustain larger vertical forces. Deep water (— 1000 meters) deployments may require a TLP design 600 that has shorter, more environmentally friendly mooring lines 602, as shown in FIG. 6. In addition, a TLP design may be the most stable platform design for big waves. The anchors described herein can be particularly advantageous because, in many instances, they can provide coupling to an underwater floor using both suction and gravity loads. Moreover, the anchors can scale in size and can be floated to the installation site. For example, during floatation the anchors can be oriented vertically in the same direction as the installation direction, and then submerged less expensively using smaller vessels. The anchors may have benefits for other floating wind turbine substructures, such as semi-submersible or barge platforms. These platforms can use various mooring configurations, such as taut, semi-taut, or slack mooring configurations. The anchor may have benefits for other mooring configurations that share mooring lines between wind turbines or share anchors between multiple mooring lines.

In some variations, such as the case of a TLP design, the pad eye of the anchor can be connected directly to the base wall to directly resist ballast loads and keep the concrete in the anchor from being placed in tension. Alternatively, the pad eye can be connected to a perimeter wall of the body, a lid, or an outer circumference of the anchor proximate the base wall.

Figure 7A:
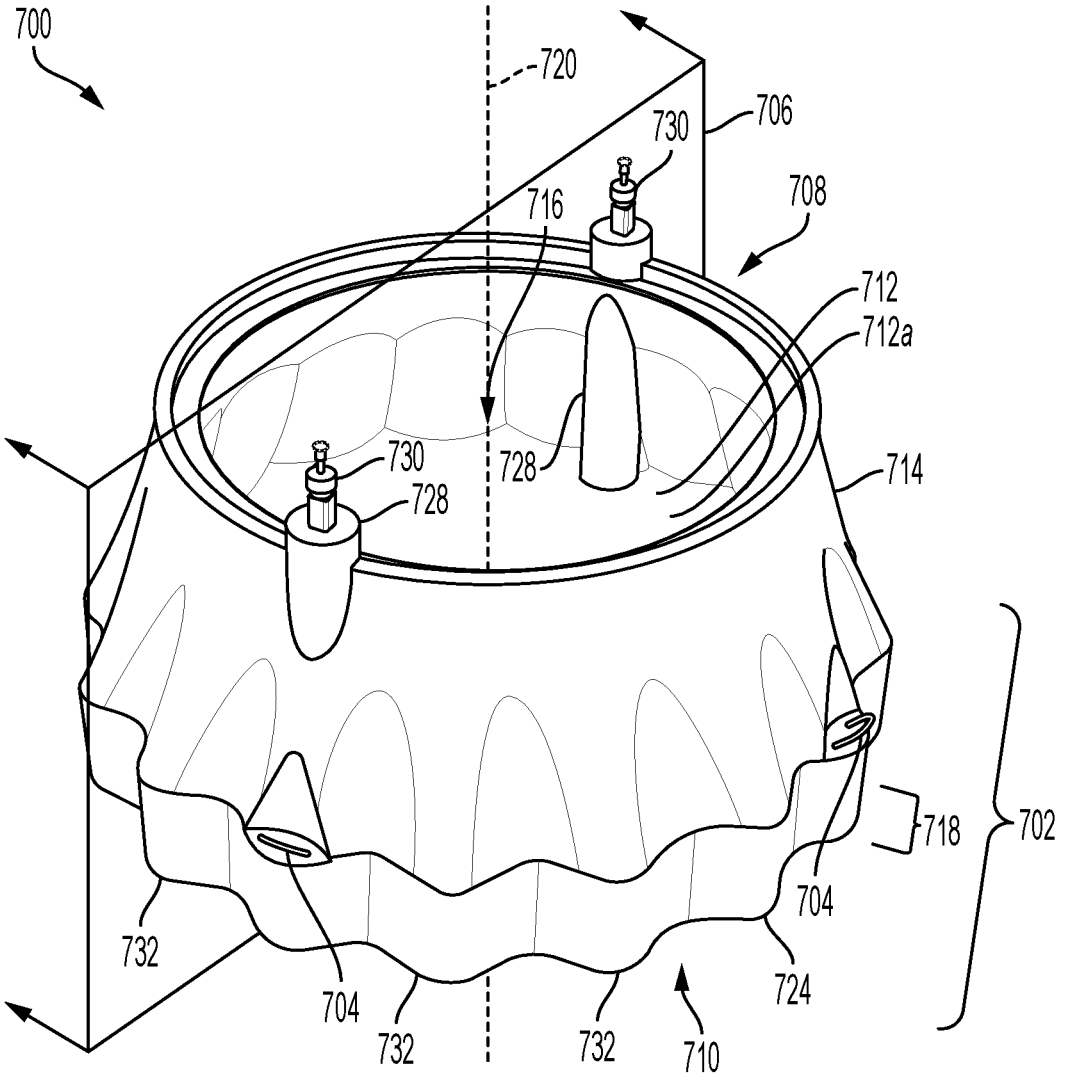
FIG. 7A is a schematic diagram, in top perspective view, of an example anchor that has a tubular body and a pad eye.
Figure 7B:
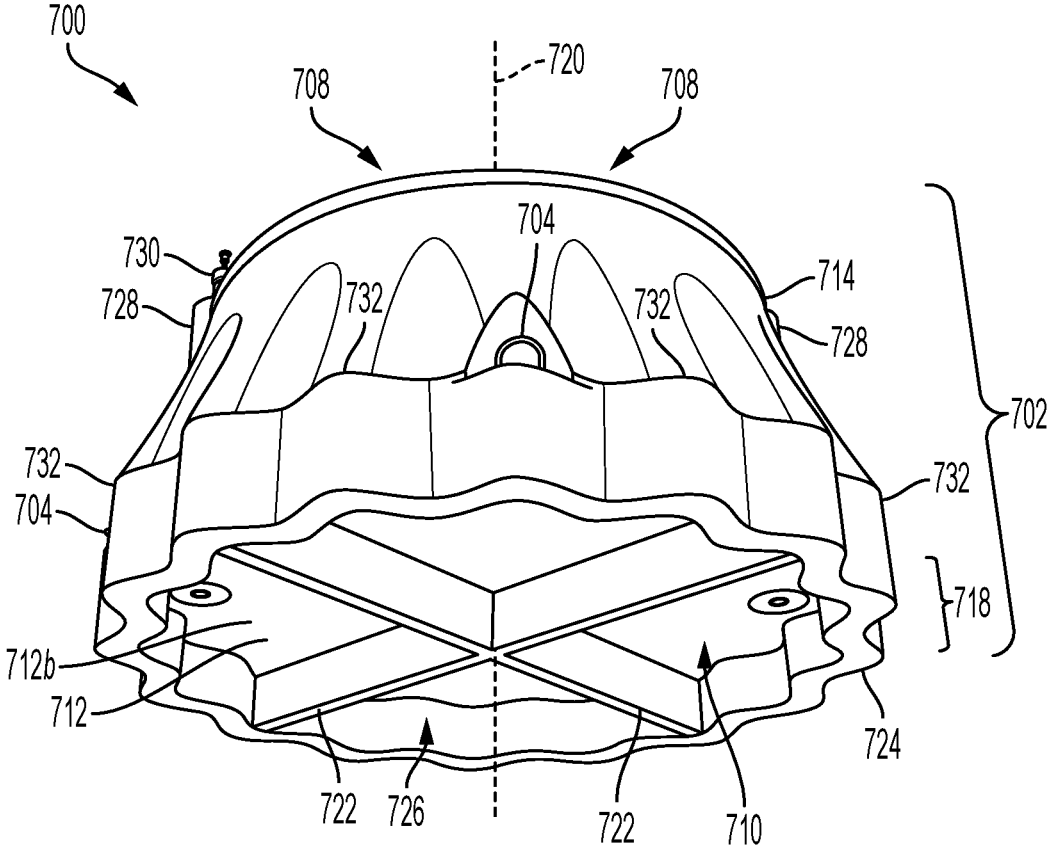
FIG. 7B is a schematic diagram, in bottom perspective view, of the example anchor of FIG. 7A.
Figure 7C:
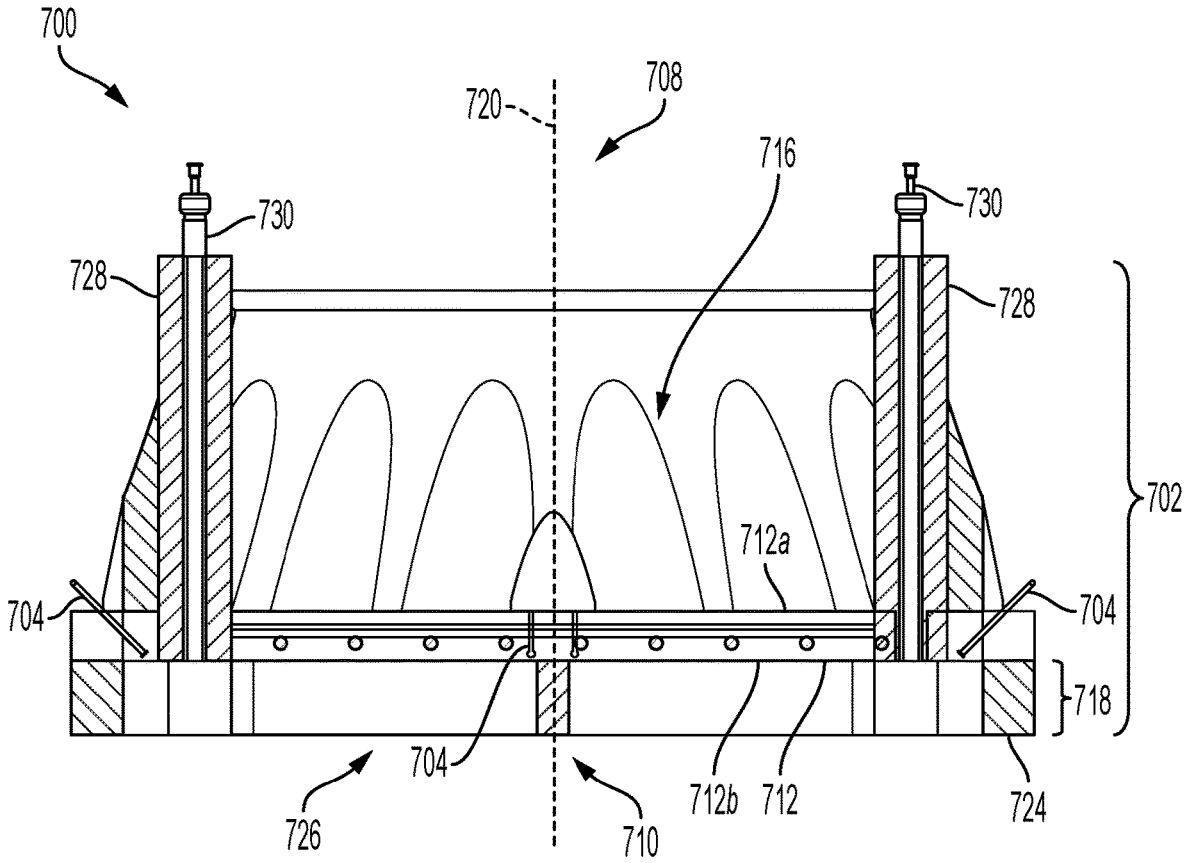
FIG. 7C is a schematic diagram, in cross-section view, of the example anchor of FIG. 7A.

Now referring to FIG. 7A, a schematic diagram is presented, in top perspective view, of an example anchor 700 that has a tubular body 702 and a pad eye 704. The pad eye 704 is coupled to the tubular body 702 and configured to couple to a mooring line. FIGS. 7B and 7C show, respectively, a bottom perspective view and a cross-section view of the example anchor of FIG. 7A. The cross-section view of FIG. 7C is taken with respect to a mid-plane 706 through the example anchor 700.

The tubular body 702 is formed at least in part of cementitious material and has an open end 708 and a closed end 710. The cementitious material may include cement and aggregate (e.g., sand or gravel). In some instances, the cementitious material may also include reinforcing elements, such as fibers (e.g., steel fibers, polymer fibers, basalt fibers, glass fibers, etc.), rebar (e.g., steel rebar, basalt rebar, etc.), mesh (e.g., steel mesh, fiber mesh, etc.), cables, tendons, staples, and so forth. The tubular body 702 includes a base wall 712 that defines the closed end 710 of the tubular body 702 and has first and second surfaces 712*a*, 712*b* on opposite sides of the base wall 712. In some variations, the base wall 712 includes an exterior surface that defines part of an exterior surface of the tubular body 702. In some variations, the base wall 712 defines an internal support structure of the tubular body 702, such as to support ballast material and to provide rigidity to the example anchor 700. In some variations, the pad eye 704 is coupled to a center portion of the first surface 712*a* of the base wall 712. In some variations, such as shown in FIGS. 7A-7C, the pad eye 704 is coupled to an exterior side surface of the base wall 712. The exterior side surface may define part of an exterior surface of the tubular body 702 proximate the closed end 710.

The tubular body 702 also includes a perimeter wall 714 that extends from the first surface 712*a* of the base wall 712 to the open end 708 of the tubular body 702. The perimeter wall 714 defines an opening into a cavity 716 of the tubular body 702 at the open end 708. In some variations, the cavity 716 is configured to define a volume that, when unfilled, allows the example anchor 700 to float when disposed on a body of water. In some variations, the pad eye 704 may be coupled to an edge surface of the perimeter wall proximate the open end 708. In some variations, the pad eye 704 is coupled to an exterior surface of the perimeter wall 714 proximate the closed end 710 of the tubular body 702 (e.g., adjacent the base wall 712).

Figure 7D:
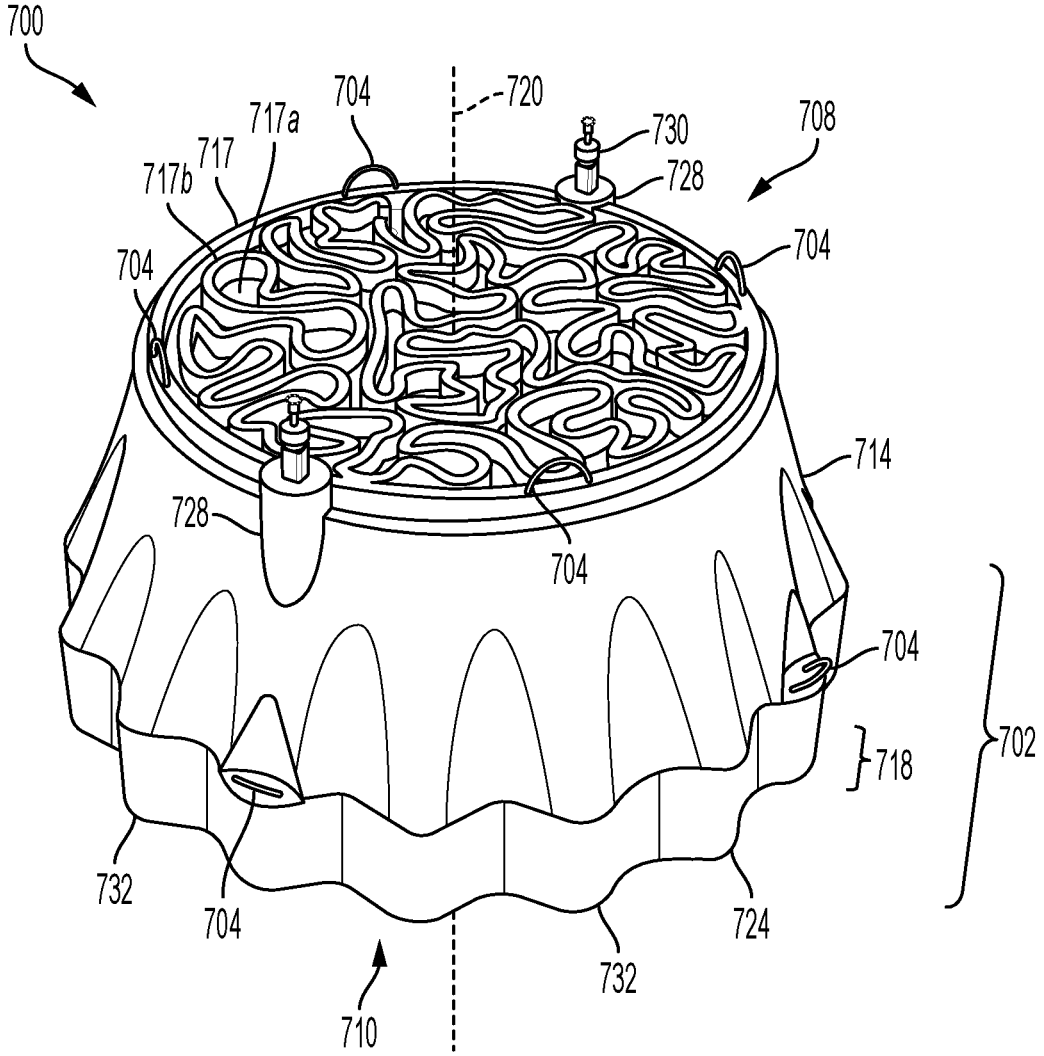
FIG. 7D is a schematic diagram, in top perspective view, of the example anchor of FIG. 7D, but in which the example anchor includes a lid that covers an open end of the example anchor.
Figure 8:
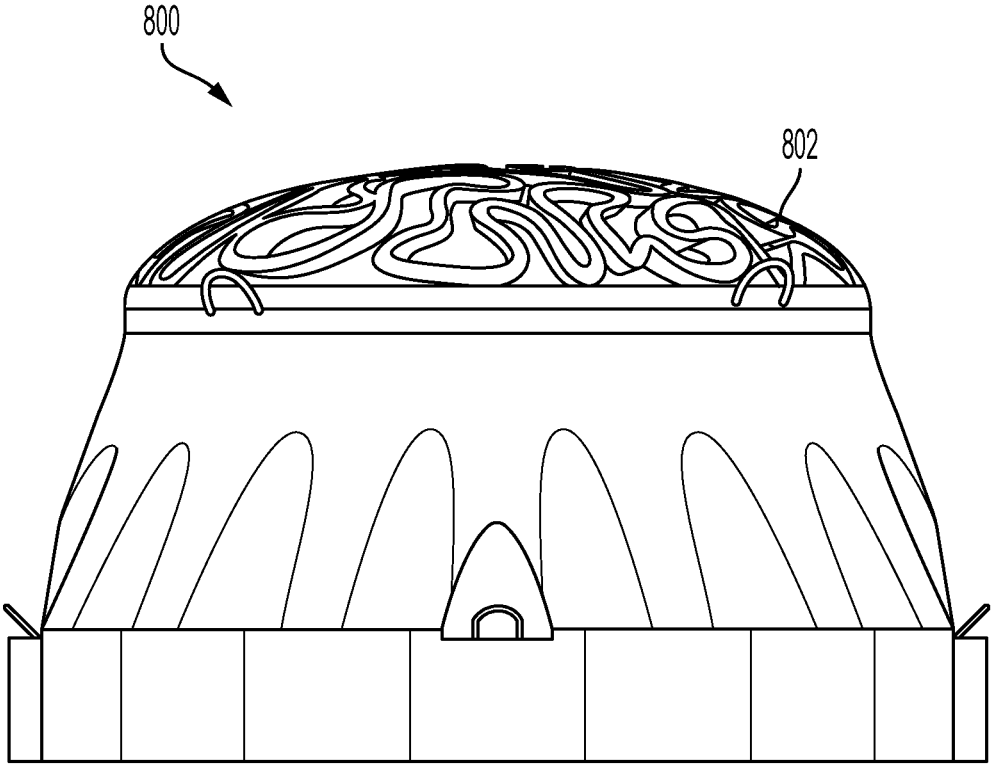
FIG. 8 is a schematic diagram, in side view, of the example anchor of FIG. 7A, but in which the example anchor includes a domed lid.

The perimeter wall 714 may, in certain cases, be configured at the open end 708 of the tubular body 702 to receive a lid that covers the open end 708 (e.g., to enclose the cavity 716). For example, an edge of the perimeter wall 714 at the open end 708 may define a lip or rim that the lid may set in to cover the open end 708. FIG. 7D presents a schematic diagram, in top perspective view, of the example anchor 700 of FIG. 7A, but in which the example anchor 700 includes a lid 717 that covers the open end 708 of the tubular body 702. The lid 717 may include a surface 717*a* configured to face an exterior of the example anchor 700 when covering the open end 708. One or more features may extend from or into the surface 717*a*, such as dimples, walls, bumps, and so forth. In some variations, such as shown in FIG. 7D, the lid 717 includes an undulating wall 717*b* that extends from the surface 717*a*. The undulating wall 717*b* may define a coral-like pattern on the surface 717*a*. However, other patterns are possible. In some variations, the lid 717 has one or more pad eyes 704 coupled thereto. Although FIG. 7D depicts the lid 717 as having a planar shape, the lid 717 may also have other shapes, such as a domed shape. The domed shape may allow the example anchor 700 to hold more ballast material. The domed shape may also present an increased surface area, thereby providing more space for marine animals to attach themselves onto the lid 717. FIG. 8 presents a schematic diagram, in side view, of an example anchor 800 that includes a domed lid 802. The example anchor 800 is configured similarly to the example anchor 700 of FIGS. 7A-7D, but lacks the conduit 728 and valve 730 of the example anchor 700.

The tubular body 702 additionally includes a shear key 718 that extends from the second surface 712*b* of the base wall 712. The shear key 718 is configured to penetrate an underwater floor and resist a lateral displacement of the example anchor 700 along the underwater floor when penetrated therein. In certain configurations, the shear key 718 may also resist a rotational displacement of the example anchor 700 about an axis 720 of the tubular body 702 when penetrated into the underwater floor. The shear key 718 may include one or more walls that extend from the second surface 712*b* of the base wall 712.

For example, the shear key 718 may include a straight wall 722 that extends from the second surface 712*b* of the base wall 712. As another example, the shear key 718 may include a plurality of radial walls (e.g., straight walls 722, curved walls, etc.) that extend from the second surface 712*b* of the base wall 712, with each radial wall aligned along a different radial direction that extends outward from a center of the base wall 712. In certain cases, the shear key 718 may include first and second sets of chord walls that extend from the second surface 712*b* of the base wall 712. In these cases, each chord wall has chord ends that terminate on the second perimeter wall 712, and the first set of chord walls are perpendicular to the second set of chord walls. An example of these cases is shown in the bottom perspective views of FIGS. 2B-2C. FIG. 3 illustrates other walls that are possible for the shear key 718.

In some variations, the shear key 718 includes a second perimeter wall 724 that is configured to convert the closed end 710 of the tubular body into a second open end, such as described in relation to the shear keys 300*a*-300*e* of FIG. 3. In further variations, such as shown in FIGS. 7A-7D, the second perimeter wall 724 defines an opening into a second cavity 726 of the tubular body 702. The second cavity 726 is configured as a suction chamber of the example anchor 700, and the example anchor 700 includes a conduit 728 that is configured to fluidly couple the suction chamber to an exterior of the example anchor 700. To do so, the conduit 728 may, in certain cases, include a valve 730 to control a flow of fluid (e.g., water, air, etc.) between the suction chamber and the exterior of the example anchor 700. Other fluid control devices are possible. In some instances, the conduit 728 is defined by a conduit wall of the tubular body 702 that is formed at least in part of cementitious material. In other instances, the conduit 728 is defined by a metal or plastic body (e.g., a steel pipe, PVC pipe, etc.) that is disposed through the tubular body 702.

In some variations, the second perimeter wall 724 includes a plurality of teeth 732, with each tooth 732 protruding from the second perimeter wall 724 along a direction perpendicular to the axis 720 of the tubular body 702. The plurality of teeth 732 may, for example, be defined by an undulation of the second perimeter wall 724, such as shown in FIGS. 7A-7D. However, other configurations are possible for the plurality of teeth 732. After installation of the example anchor 700, the plurality of teeth 732 may assist the shear key 718 in resisting the rotational displacement of the example anchor 700 about the axis 720 of the tubular body 702. The straight walls 722 may also assist the shear key 718 in resisting the rotational displacement of the example anchor 700.

In some implementations, the example anchor 700 is configured to resist overturning when penetrated into the underwater floor. For example, the tubular body 702 may be configured to have a length and a maximum diameter, with the length being no greater than the maximum diameter. In this configuration, the tubular body 702 may define a "squat" body for the example anchor 700. As another example, the tubular body 702 may have a frustrum shape. As such, a diameter of the perimeter wall 714 at the open end 708 of tubular body 702 may be less than a diameter of the perimeter wall 714 at, or proximate to, the base wall 712.

Figure 9:
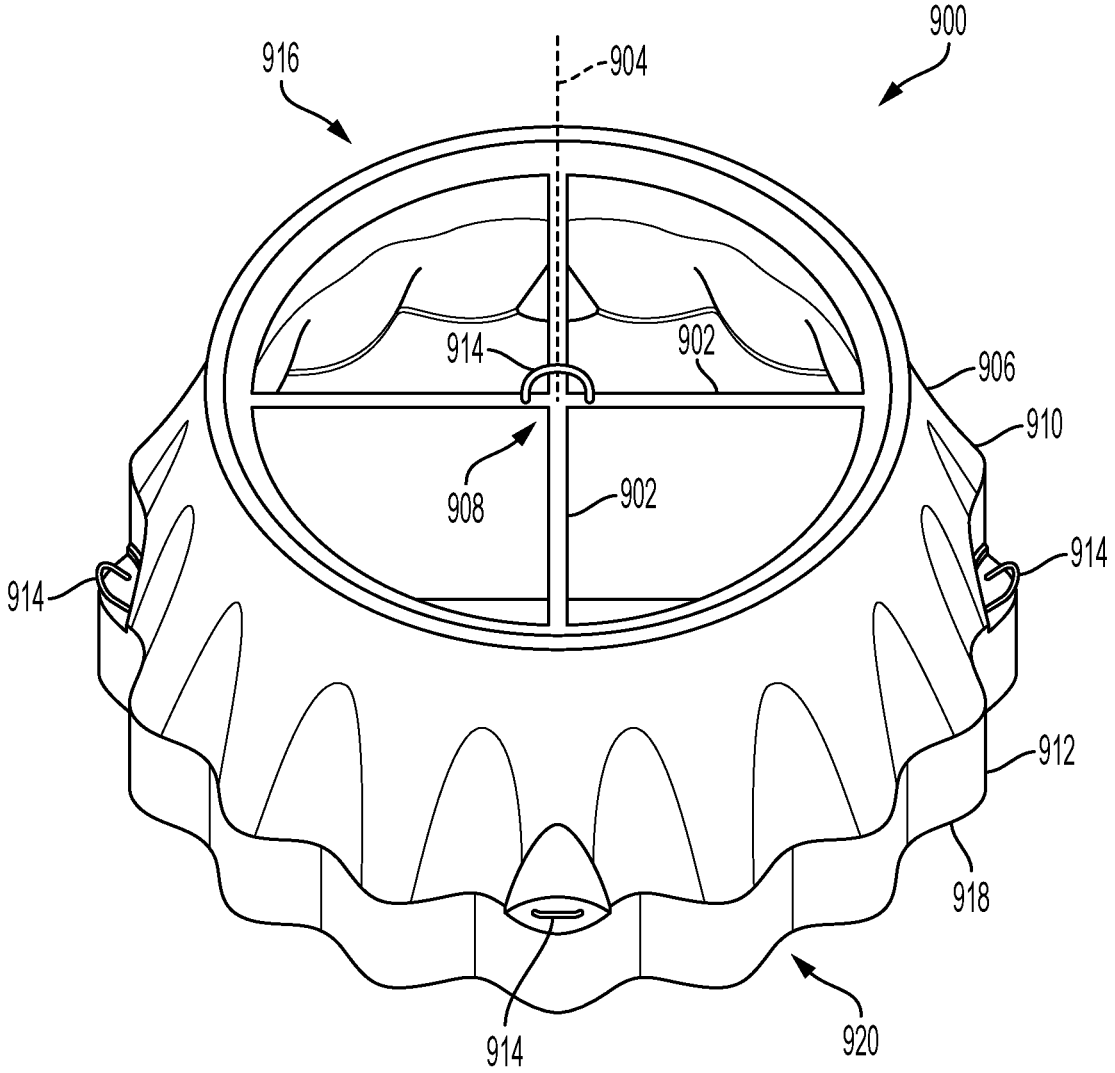
FIG. 9 is a schematic diagram, in top perspective view, of an example anchor that has a plurality of stiffening walls.

In some implementations, the example anchor 700 includes stiffening walls to increase the rigidity of its body. For example, the tubular body 702 may extend along the axis 720 and include a stiffening wall in the cavity 716 that is oriented parallel to the axis 720. The stiffening wall may have first and second wall ends and extend therebetween. The first and second wall ends may be terminated by the perimeter wall 714. FIG. 9 presents a schematic diagram, in top perspective view, of an example anchor 900 that has a plurality of stiffening walls 902. Each stiffening wall 902 passes through an axis 904 of a tubular body 906 to define a common wall intersection 908. The tubular body 906 includes a base wall (not shown), a perimeter wall 910, and a shear key 912. A pad eye 914 is coupled to the common wall intersection 908 proximate an open end 916 of the tubular body 906. The shear key 912 includes a second perimeter wall 918 that converts an otherwise closed end of the tubular body 906 into a second open end 920. Four pad eyes 910 are also coupled to an exterior side surface of the base wall. The exterior side surface may define part of an exterior surface of the tubular body 906.

The anchor described herein may be manufactured by depositing layers of flowable cementitious material. In some implementations, a method of manufacturing an anchor includes depositing layers of flowable cementitious material on top of each other to form at least part of a tubular body. The flowable cementitious material is capable of hardening into solidified cementitious material. Moreover, the tubular body may have features, such as described in relation to FIGS. 2A-9. For example, the tubular body may have open and closed ends an include a base wall that defines the closed end of the tubular body and has first and second surfaces on opposite sides of the base wall. The tubular body may also include a perimeter wall that extends from the first surface of the base wall to the open end of the tubular body. The perimeter wall may define an opening into a cavity of the tubular body at the open end. The tubular body may additionally include a shear key that extends from the second surface of the base wall. The shear key is configured to penetrate an underwater floor and resist a lateral displacement of the anchor along the underwater floor when penetrated therein. The method also includes securing a pad eye to the tubular body, the pad eye configured to couple to a mooring line, and in many implementations, also includes hardening the layers of flowable cementitious material into layers of solidified cementitious material. In some variations, securing the pad eye to the tubular body includes coupling the pad eye to a reinforcing element of the tubular body before hardening the layers of flowable cementitious material.

The operation of depositing the layers of flowable cementitious material may be part of an manufacturing process that includes 3D casting (which can 3D print stayform walls into which concrete materials are cast), concrete spraying, precasting, casting, slip forming, and so forth. In some implementations, depositing the layers of flowable cementitious material includes spraying layers of the flowable cementitious material on top of each other. In some implementations, depositing the layers of flowable cementitious materials includes printing layers of the flowable cementitious material on top of each other.

In some implementations, the shear key includes a second perimeter wall that is configured to convert the closed end of the tubular body into a second open end. The second perimeter wall may define an opening into a second cavity of the tubular body, and the second cavity may be configured as a suction chamber of the anchor. Moreover, the anchor may include a conduit configured to fluidly couple the suction chamber to an exterior of the anchor. In this case, the conduit may be defined by a conduit wall of the tubular body. As such, and in some variations, depositing layers of flowable cementitious material may include depositing layers of flowable cementitious material to form, at least in part, the conduit wall.

In some aspects of what is described, an anchor may be described by the following examples. The anchor may, in certain cases, be used for securing floating structures to an underwater floor.

Example 1. An anchor, comprising:

a tubular body formed at least in part of cementitious material and having open and closed ends, the tubular body comprising:

a base wall that defines the closed end of the tubular body and has first and second surfaces on opposite sides of the base wall, a perimeter wall that extends from the first surface of the base wall to the open end of the tubular body, the perimeter wall defining an opening into a cavity of the tubular body at the open end, and a shear key extending from the second surface of the base wall, the shear key configured to penetrate an underwater floor and resist a lateral displacement of the anchor along the underwater floor when penetrated therein; and a pad eye coupled to the tubular body and configured to couple to a mooring line.

Example 2. The anchor of example 1, wherein the tubular body extends along an axis and comprises:

a stiffening wall in the cavity that is oriented parallel to the axis, the stiffening wall having first and second wall ends and extending therebetween, the first and second wall ends terminated by the perimeter wall.

Example 3. The anchor of example 2, wherein the stiffening wall comprises a plurality of stiffening walls, each passing through the axis to define a common wall intersection; and wherein the pad eye is coupled to the common wall intersection proximate the open end of the tubular body.

Example 4. The anchor of example 1 or any one of examples 2-3, wherein the pad eye is coupled to an edge surface of the perimeter wall proximate the open end.

Example 5. The anchor of example 1 or any one of examples 2-3, wherein the pad eye is coupled to an exterior side surface of the base wall.

Example 6. The anchor of example 1 or any one of examples 2-3, wherein the pad eye is coupled to a center portion of the first surface of the base wall.

Example 7. The anchor of example 1 or any one of examples 2-6, wherein the anchor comprises ballast material disposed in the cavity.

Example 8. The anchor of example 1 or any one of examples 2-7, wherein the cavity is configured to define a volume that, when unfilled, allows the anchor to float when disposed on a body of water.

Example 9. The anchor of example 1 or any one of examples 2-8, wherein the perimeter wall is configured at the open end of the tubular body to receive a lid that covers the open end.

Example 10. The anchor of example 9, comprising the lid.

Example 11. The anchor of example 10, wherein the lid comprises:

a surface configured to face an exterior of the anchor when covering the open end; and an undulating wall that extends from the surface.

Example 12. The anchor of example 1 or any one of examples 2-11, wherein the shear key is further configured to resist a rotational displacement of the anchor about an axis of the tubular body when penetrated into the underwater floor.

Example 13. The anchor of example 12, wherein the shear key comprises a straight wall extending from the second surface of the base wall.

Example 14. The anchor of example 12 or example 13, wherein the shear key comprises a plurality of radial walls that extend from the second surface of the base wall, each radial wall aligned along a different radial direction that extends outward from a center of the base wall.

Example 15. The anchor of example 1 or any one of examples 2-14, wherein the shear key comprises a second perimeter wall that is configured to convert the closed end of the tubular body into a second open end.

Example 16. The anchor of example 15, wherein the shear key comprises first and second sets of chord walls that extend from the second surface of the base wall, each chord wall having chord ends that terminate on the second perimeter wall, the first set of chord walls perpendicular to the second set of chord walls.

Example 17. The anchor of example 15 or example 16, wherein the second perimeter wall defines an opening into a second cavity of the tubular body, the second cavity configured as a suction chamber of the anchor; and wherein the anchor comprises a conduit configured to fluidly couple the suction chamber to an exterior of the anchor.

Example 18. The anchor of example 17, wherein the conduit is defined by a conduit wall of the tubular body that is formed at least in part of cementitious material.

Example 19. The anchor of example 15 or any one of examples 16-18, wherein the second perimeter wall comprises a plurality of teeth, each tooth protruding from the second perimeter wall along a direction perpendicular to an axis of the tubular body.

Example 20. The anchor of example 19, wherein each tooth is defined by an undulation of the second perimeter wall.

Example 21. The anchor of example 1 or any one of examples 2-20, wherein the tubular body has a frustrum shape; and wherein a diameter of the perimeter wall at the open end of tubular body is less than a diameter of the perimeter wall at the base wall.

Example 22. The anchor of example 1 or any one of examples 2-21, wherein a length of the tubular body is no greater than a maximum diameter of the tubular body.

In some aspects of what is described, a method may be described by the following examples. The method may, in certain cases, be used to manufacture an anchor, such as an anchor for securing floating structures to an underwater floor.

Example 23. A method of manufacturing an anchor, comprising:

depositing layers of flowable cementitious material on top of each other to form at least part of a tubular body, the flowable cementitious material capable of hardening into solidified cementitious material, the tubular body having open and closed ends and comprising:

a base wall that defines the closed end of the tubular body and has first and second surfaces on opposite sides of the base wall, a perimeter wall that extends from the first surface of the base wall to the open end of the tubular body, the perimeter wall defining an opening into a cavity of the tubular body at the open end, and a shear key extending from the second surface of the base wall, the shear key configured to penetrate an underwater floor and resist a lateral displacement of the anchor along the underwater floor when penetrated therein; and securing a pad eye to the tubular body, the pad eye configured to couple to a mooring line.

Example 24. The method of example 23, comprising:

hardening the layers of flowable cementitious material into layers of solidified cementitious material.

Example 25. The method of example 24, wherein securing the pad eye to the tubular body comprises coupling the pad eye to a reinforcing element of the tubular body before hardening the layers of flowable cementitious material.

Example 26. The method of example 23 or any one of examples 24-25, wherein depositing the layers of flowable cementitious material comprises spraying layers of the flowable cementitious material on top of each other.

Example 27. The method of example 23 or any one of examples 24-26, wherein depositing the layers of flowable cementitious materials comprises printing layers of the flowable cementitious material on top of each other.

Example 28. The method of example 23 or any one of examples 24-27, comprising:

disposing reinforcing elements in the flowable cementitious material before depositing the layers.

Example 29. The method of example 23 or any one of examples 24-28, wherein the tubular body extends along an axis and comprises:

a stiffening wall in the cavity that is oriented parallel to the axis, the stiffening wall having first and second wall ends and extending therebetween, the first and second wall ends terminated by the perimeter wall.

Example 30. The method of example 23 or any one of examples 24-29, wherein the cavity is configured to define a volume that, when unfilled, allows the anchor to float when disposed on a body of water.

Example 31. The method of example 23 or any one of examples 24-30, wherein the perimeter wall is configured at the open end of the tubular body to receive a lid that covers the open end.

Example 32. The method of example 23 or any one of examples 24-31, wherein the shear key is further configured to resist a rotational displacement of the anchor about an axis of the tubular body when penetrated into the underwater floor.

Example 33. The method of example 32, wherein the shear key comprises a straight wall extending from the second surface of the base wall.

Example 34. The method of example 23 or any one of examples 24-33, wherein the shear key comprises a second perimeter wall that is configured to convert the closed end of the tubular body into a second open end.

Example 35. The method of example 34, wherein the second perimeter wall defines an opening into a second cavity of the tubular body, the second cavity configured as a suction chamber of the anchor; and wherein the anchor comprises a conduit configured to fluidly couple the suction chamber to an exterior of the anchor.

Example 36. The method of example 35, wherein the conduit is defined by a conduit wall of the tubular body; and wherein depositing layers of flowable cementitious material comprises depositing layers of flowable cementitious material to form, at least in part, the conduit wall.

Example 37. The method of example 34 or any one of examples 35-36, wherein the second perimeter wall comprises a plurality of teeth, each tooth protruding from the second perimeter wall along a direction perpendicular to an axis of the tubular body.

While this specification contains many details, these should not be understood as limitations on the scope of what may be claimed, but rather as descriptions of features specific to particular examples. Certain features that are described in this specification or shown in the drawings in the context of separate implementations can also be combined. Conversely, various features that are described or shown in the context of a single implementation can also be implemented in multiple embodiments separately or in any suitable subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single product or packaged into multiple products.

A number of embodiments have been described. Nevertheless, it will be understood that various modifications can be made. Accordingly, other embodiments are within the scope of the following claims.

What is claimed is:

1. An anchor, comprising:

a tubular body formed at least in part of cementitious material and having open and closed ends, the tubular body comprising:

a base wall that defines the closed end of the tubular body and has first and second surfaces on opposite sides of the base wall, a perimeter wall that extends from the first surface of the base wall to the open end of the tubular body, the perimeter wall defining an opening into a cavity of the tubular body at the open end, and a shear key extending from the second surface of the base wall, the shear key configured to penetrate an underwater floor and resist a lateral displacement of the anchor along the underwater floor when penetrated therein; and a pad eye coupled to a portion of the tubular body and configured to couple to a mooring line, the portion of the tubular body comprising:

an exterior side surface of the base wall, or a surface of the perimeter wall.

2. The anchor of claim 1, wherein the tubular body extends along an axis and comprises:

a stiffening wall in the cavity that is oriented parallel to the axis, the stiffening wall having first and second wall ends and extending therebetween, the first and second wall ends terminated by the perimeter wall.

3. The anchor of claim 1, wherein the surface of the perimeter wall is an edge surface of the perimeter wall proximate the open end.

4. The anchor of claim 1, wherein the portion of the tubular body comprises a center portion of the first surface of the base wall.

5. The anchor of claim 1, wherein the anchor comprises ballast material disposed in the cavity.

6. The anchor of claim 1, wherein the cavity is configured to define a volume that, when unfilled, allows the anchor to float when disposed on a body of water.

7. The anchor of claim 1, wherein the perimeter wall is configured at the open end of the tubular body to receive a lid that covers the open end.

8. The anchor of claim 1, wherein the shear key comprises a second perimeter wall that is configured to convert the closed end of the tubular body into a second open end.

9. The anchor of claim 8, wherein the second perimeter wall defines an opening into a second cavity of the tubular body, the second cavity configured as a suction chamber of the anchor; and wherein the anchor comprises a conduit configured to fluidly couple the suction chamber to an exterior of the anchor.

10. The anchor of claim 1, wherein the tubular body has a frustrum shape; and wherein a diameter of the perimeter wall at the open end of tubular body is less than a diameter of the perimeter wall at the base wall.

11. The anchor of claim 1, wherein a length of the tubular body is no greater than a maximum diameter of the tubular body.

12. A method of manufacturing an anchor, comprising:

depositing layers of flowable cementitious material on top of each other to form at least part of a tubular body, the flowable cementitious material capable of hardening into solidified cementitious material, the tubular body having open and closed ends and comprising:

a base wall that defines the closed end of the tubular body and has first and second surfaces on opposite sides of the base wall, a perimeter wall that extends from the first surface of the base wall to the open end of the tubular body, the perimeter wall defining an opening into a cavity of the tubular body at the open end, and a shear key extending from the second surface of the base wall, the shear key configured to penetrate an underwater floor and resist a lateral displacement of the anchor along the underwater floor when penetrated therein; and securing a pad eye to a portion of the tubular body, the pad eye configured to couple to a mooring line, the portion of the tubular body comprising:

an exterior side surface of the base wall, or a surface of the perimeter wall.

13. The method of claim 12, comprising:

hardening the layers of flowable cementitious material into layers of solidified cementitious material.

14. The method of claim 12, comprising:

disposing reinforcing elements in the flowable cementitious material before depositing the layers.

15. The method of claim 12, wherein the tubular body extends along an axis and comprises:

a stiffening wall in the cavity that is oriented parallel to the axis, the stiffening wall having first and second wall ends and extending therebetween, the first and second wall ends terminated by the perimeter wall.

16. The method of claim 12, wherein the cavity is configured to define a volume that, when unfilled, allows the anchor to float when disposed on a body of water.

17. The method of claim 12, wherein the perimeter wall is configured at the open end of the tubular body to receive a lid that covers the open end.

18. The method of claim 12, wherein the shear key comprises a second perimeter wall that is configured to convert the closed end of the tubular body into a second open end.

19. The method of claim 18, wherein the second perimeter wall defines an opening into a second cavity of the tubular body, the second cavity configured as a suction chamber of the anchor; and wherein the anchor comprises a conduit configured to fluidly couple the suction chamber to an exterior of the anchor.

* * * * *